US008695394B2

(12) United States Patent
Makino

(10) Patent No.: US 8,695,394 B2
(45) Date of Patent: Apr. 15, 2014

(54) LOWER DIE FOR PRESS BENDING AND TOOL USING THE SAME

(76) Inventor: Osamu Makino, Fuchu (JP)

( * ) Notice: Subject to any disclaimer, the term of this patent is extended or adjusted under 35 U.S.C. 154(b) by 168 days.

(21) Appl. No.: 12/851,863

(22) Filed: Aug. 6, 2010

(65) Prior Publication Data

US 2011/0030436 A1 Feb. 10, 2011

(30) Foreign Application Priority Data

Aug. 6, 2009 (JP) ..... 2009-183295

(51) Int. Cl.
*B21D 5/04* (2006.01)

(52) U.S. Cl.
USPC ..... 72/387; 72/313

(58) Field of Classification Search
USPC ..... 72/387, 319, 396, 313
See application file for complete search history.

(56) References Cited

U.S. PATENT DOCUMENTS 4,181,002 A * 1/1980 Eckold et al. ..... 72/387
4,434,644 A * 3/1984 Gargrave et al. ..... 72/387
4,535,619 A * 8/1985 Gargrave ..... 72/481.1
4,558,582 A * 12/1985 Meinig ..... 72/381
5,365,766 A * 11/1994 Takahashi et al. ..... 72/387
5,913,931 A * 6/1999 Gargrave et al. ..... 72/387
6,065,324 A * 5/2000 Russell ..... 72/387
6,672,127 B2 * 1/2004 Maida ..... 72/389.4
6,983,634 B2 * 1/2006 Chun et al. ..... 72/387
7,584,640 B1 * 9/2009 Liu et al. ..... 72/389.3
2008/0282760 A1 * 11/2008 Chun et al. ..... 72/387

* cited by examiner

*Primary Examiner* — Faye Francis
(74) *Attorney, Agent, or Firm* — Browdy and Neimark, PLLC

(57) ABSTRACT

In order to achieve a bending operation which provides a U-shaped metal piece of increased depth and to provide a bending operation safe to an operator involved in the bending operation, the invention is a lower die for press bending which includes: a block body which includes a groove on an upper surface thereof, the groove extending in a right and left direction, and the block body being fixed to a bending machine; and a rotating block which is received by the groove of the block body and is capable of oscillating about an axis of the groove, wherein a process groove is formed on an upper surface of the rotating block to receive a blade edge of an upper die. The block body includes a front shoulder and a rear shoulder at the front and rear sides of the groove. A level difference is defined between these shoulders such that the front shoulder is smaller in height than the rear shoulder.

5 Claims, 9 Drawing Sheets

LOWER DIE FOR PRESS BENDING AND TOOL USING THE SAME

BACKGROUND OF THE INVENTION

1. Field of the Invention

The present invention relates to a tool for press bending (hereinafter, referred to as a "bending tool") mounted on a press bending machine (or a "press brake") which is a bending apparatus for bending mechanical parts, such as metal plates. More particularly, the invention relates to a lower die of the bending tool.

2. Description of the Related Art

Many L-shaped or U-shaped metal pieces are manufactured as brackets or reinforcing members of various machines or devices. A related art bending tool for manufacturing such L-shaped or U-shaped metal pieces and operation states thereof are described in JP-B-58-41927 and illustrated in FIG. 9 of the present application.

FIG. 9 illustrates the manufacture of an ordinary L-shaped metal piece. With this unit, an L-shaped bending tool (i.e., a die) 2 and a V-block 3 are disposed opposite to each other along a vertical direction. The die 2 corresponds to an upper die fixed to a bending machine body 1 with a bolt 5 or other means. The V-block 3 corresponds to a lower die fixed to a table 4 of a bending machine. One or both of the die 2 and the V-block 3 are moved upward or downward to approach their counterpart for the bending operation. The die 2 has a substantially right-angled, wedge-shaped sharp tip of which bisector substantially corresponds to a plumb line. The V-block 3 has a groove, i.e., a recess, consisting of sloped surfaces crossing each other at the right angle. The V-block 3 also has a bisector which substantially corresponds to the plumb line. The die 2 and the V-block 3 are configured such that the tip of the die 2 and the groove of the V-block 3 conform to each other without any misalignment when the die 2 and the V-block 3 are brought together. When the die 2 is pressed against the V-block 3 on which a metal sheet 6 is placed, the metal sheet 6 is pressed by the die 2 into the groove of the V-block 3. Pressing pressure causes a plastic deformation of the metal sheet 6 into an L shape of which bending portion being substantially right-angled. In this manner, an L-shaped metal piece is manufactured.

A U-shaped metal piece is manufactured in the following manner. The metal sheet 6 is placed on the V-block 3 in a manner similar to that described above. The metal sheet 6 is bent in a first bending operation into L shape at a certain bending position (i.e., location) set for the bending of the metal sheet 6 into U shape. In this manner, an L-shaped work 6*a* (indicated by dashed dotted lines in FIG. 9) bent into the right angle at a first bending point 7*a* is obtained. The thus-obtained L-shaped work is moved along a front-rear direction on the V-block 3 to set a bending position (i.e., location) for bending into U shape (in FIG. 9, the right side is defined as a front side and the left side is defined as a rear side, which definition of the direction will be adopted throughout the specification.). The metal sheet 6 is bent at the bending position into L shape. In this manner, a U-shaped metal piece 6*b* (indicated by solid lines in FIG. 9) is obtained which is bent into the right angle at a second bending point 7*b* and is also bent at the first bending point 7*a*. As described above, the U-shaped metal piece 6*b* is manufactured through bending operations into L shape at two different positions on the metal sheet 6. A side between the two positions at which the metal sheet 6 is bent into L shape is defined as a base 8*a* of the U-shaped metal piece 6*b*.

Although the related art bending tool has certain effects and utility as described above, it has the following deficiencies. When the metal sheet 6 is bent into L shape as illustrated in FIG. 9 using the above-described related art bending tool, the metal sheet 6 placed on the block 3 at a horizontal position is bent into the right angle at the bending point when the die 2 and the block 3 are brought together and thereby the metal sheet 6 is moved upward by 45 degrees at a front side of the bending machine body 1. The upward movement of the metal sheet 6 is unsafe to an operator who puts materials in and out at this front position.

The metal sheet 6 is bent into L shape twice using the related art bending tool during the manufacture of the U-shaped metal piece 6*b* as illustrated in FIG. 9. When the metal sheet 6 is bent in the second bending operation into L shape, the base 8*a* of the U-shaped metal piece 6*b* extends at 45 degrees with respect to the horizontal plane from the second bending point 7*b* formed in the second bending operation. A vertical side 8*b* (which corresponds to one of legs of the U-shaped metal piece 6*b*) extends at 90 degrees from an end of the base 8*a* (i.e., from the first bending point 7*a*). Thus the vertical side 8*b* extends from the end of the base 8*a* at 135 degrees (i.e., at a reversed angle of 45 degrees). Even if the vertical side 8*b* extends at the reversed angle of 45 degrees, there is no problem as long as a required length of the vertical side 8*b* is sufficiently small. However, when it is desirable to manufacture a U-shaped metal piece 6*b* with a longer vertical side 8*b* (i.e., a U-shaped metal piece 6*b* of larger depth with respect to the length of the base 8*a*), an end 8*c* of the vertical side 8*b* interferes with a surface of the bending machine body 1 as illustrated in FIG. 9. It is therefore impossible to provide any longer vertical side 8*b*. This means that the related art bending tool can provide only U-shaped metal pieces 6*b* of comparatively small depth with respect to the length of the base 8*a*. In the exemplary U-shaped metal piece 6*b* illustrated in FIG. 9, a dimensional ratio of the base to the vertical side is about 1:0.55.

In order to solve these related art problems, an object of the invention is to achieve a bending tool which provides a U-shaped metal piece of increased depth, reliably bends a work which is longer (as compared with a processing material of ordinary length) without interference with a processing machine or a neighborhood thereof, and provides a bending operation safe to an operator involved in the bending operation.

SUMMARY OF THE INVENTION

To achieve the above object, the bending tool of the invention is characterized by an improved lower die. A lower die for press bending includes: a block body which includes a groove on an upper surface thereof, the groove extending in a right and left direction, and the block body being fixed to a bending machine; and a rotating block which is received by the groove of the block body and is capable of oscillating about an axis of the groove, wherein a process groove is formed on an upper surface of the rotating block to receive a blade edge of an upper die. The block body of the lower die includes a front shoulder and a rear shoulder at the front and rear sides of the groove. The front shoulder is smaller in height than the rear shoulder. That is, a level difference is defined between the front shoulder and the rear shoulder such that the front shoulder is lower than the rear shoulder. The groove is formed as a hollow cylinder with a substantially semicircular cross section. Preferably, the rotating block is formed as a cylinder with a semicircular cross section conforming to the groove. There are some variations in the shape of the groove and the configuration of the rotating block. On the upper surface of the rotating block, the process groove is formed to extend in the longitudinal direction of the rotating block. Although there is no stringent restriction about a sectional shape of the process groove, it is preferable that a front wall of the process groove extends downward at a substantially right angle from the upper surface while a rear wall is formed on a plane extending toward a front lower direction from the upper surface. It suffices that a bottom surface of the process groove is located at a depth position to sufficiently receive an end portion of an upper die. The process groove may be located slightly forward of a central axis of the rotating block (i.e., off-centered) when seen in a cross section in order for a reliable forward rotation of the rotating block when the upper die and the lower die are brought together. The upper die may be selected from known dies for bending. A blade edge of the die is configured to be rotated to conform to the rotation of the rotating block.

With the thus-configured lower die, when the die, which is the upper die, and the lower die are brought together with the metal sheet placed on the lower die, the blade edge of the die enters the process groove of the rotating block while bending the metal sheet. A level difference is defined between the front shoulder and the rear shoulder such that the front shoulder is lower than the rear shoulder in the block body. Thus, when the rotating block rotates forward in the bending machine, a front side of the rotating block is moved downward while a rear side is moved upward. At the bending point, the L-shaped work is inclined forward together with the rotating block which is inclined forward of the bending machine. Thus the front side of the L-shaped work is moved upward by an angle smaller than 45 degrees with respect to the horizontal plane at the front side of the bending machine. Thus the amount of upward movement of the metal sheet during the bending operation can be controlled to the minimum. With this configuration, the operator can stay safe. For the manufacture of the U-shaped metal piece, the U-shaped metal piece is also inclined forward together with the rotating block which is inclined forward of the bending machine at the bending point (which corresponds to the second bending point 7*b* described above). Thus the front side of the base of the U-shaped metal piece is moved upward by an angle smaller than 45 degrees with respect to the horizontal plane at the front side of the bending machine. The reversed angle of the vertical side of the U-shaped metal piece is smaller than 45 degrees. The vertical side extends in the direction much closer to the plumb line. It rarely happens that the end of the vertical side interferes with the body of the bending machine even if the vertical side is long.

Effect of the Invention

With the configurations described above, the bending tool of the invention has the following effects.

(1) When the upper die and the lower die are brought together with the metal sheet placed on the lower die, the blade edge of the upper die enters the process groove of the rotating block while bending the metal sheet and the rotating block is rotated forward. The L-shaped work is inclined forward at the bending point together with the rotating block which is inclined forward of the bending machine. The front side of the L-shaped work is moved upward by an angle smaller than 45 degrees with respect to the horizontal plane at the front side of the bending machine. Thus the amount of upward movement of the metal sheet during the bending operation can be controlled to the minimum. With this configuration, the operator can stay safe.

(2) For the manufacture of the U-shaped metal piece, the U-shaped metal piece is also inclined forward together with the rotating block which is inclined forward of the bending machine at the bending point (which corresponds to the second bending point 7*b* described above). Thus the front side of the base of the U-shaped metal piece is moved upward by an angle smaller than 45 degrees with respect to the horizontal plane at the front side of the bending machine. The reversed angle of the vertical side of the U-shaped metal piece is much smaller than 45 degrees. The vertical side extends in the direction much closer to the plumb line. It rarely happens that the end of the vertical side interferes with the body of the bending machine even if the vertical side is long. Accordingly, a U-shaped metal piece of increased depth can be manufactured through bending.

DESCRIPTION OF THE PREFERRED EMBODIMENTS

Figure 1:
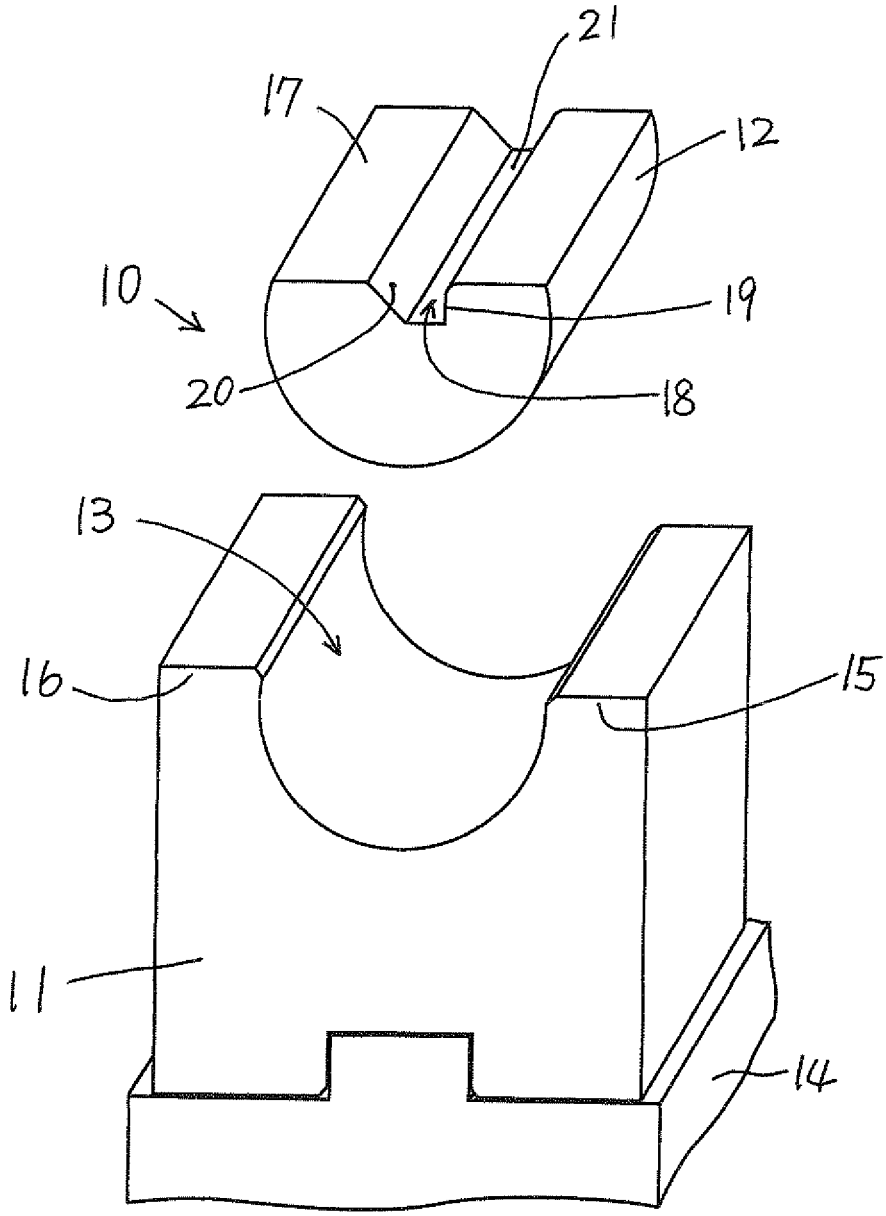
FIG. 1 is an exploded perspective view of a lower die of a tool for press bending according to an embodiment of the invention.
Figure 2:
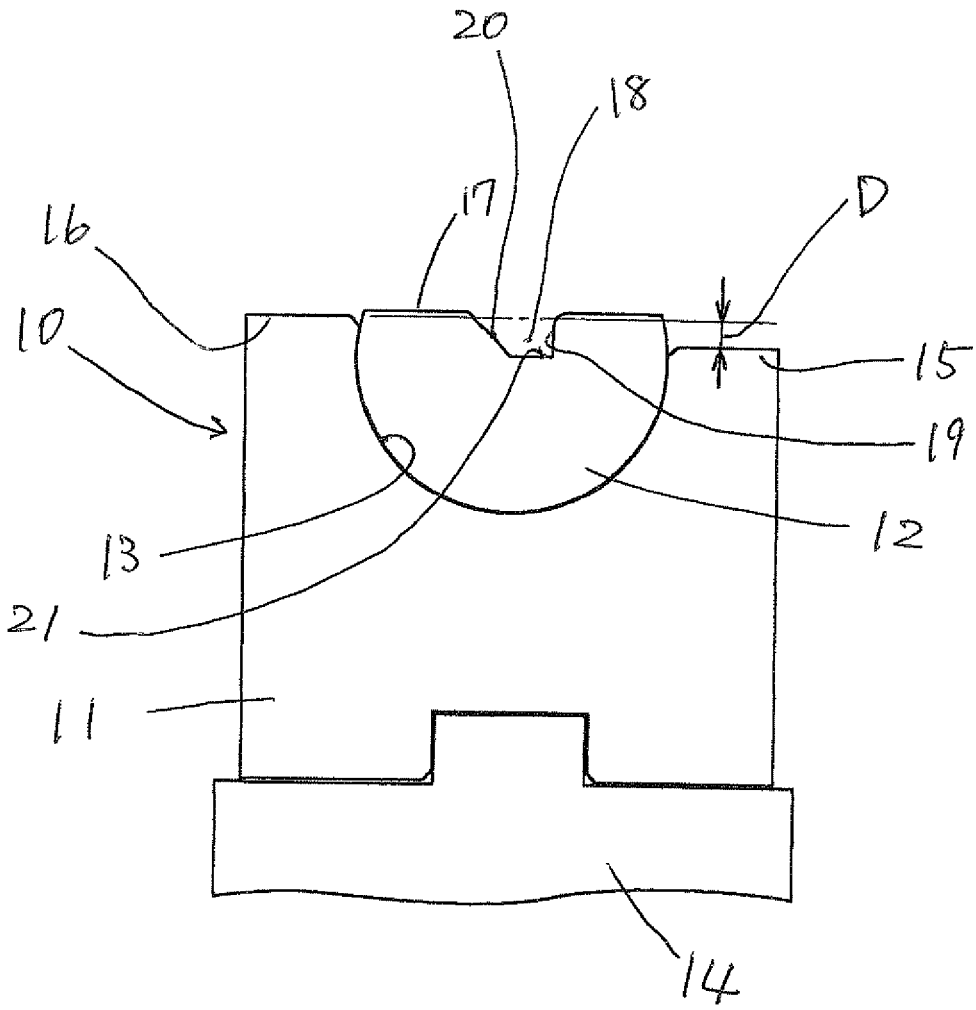
FIG. 2 is a left side view of the lower die of the tool for press bending according to the embodiment.

Hereinafter, a first embodiment of the invention will be described with reference to the drawings. FIG. 1 is an exploded perspective view of a lower die of a tool for press bending according to the first embodiment of the invention and FIG. 2 is a left side view thereof. As illustrated in FIGS. 1 and 2, the lower die 10 comprises a block body 11 and a rotating block 12. On an upper surface of the block body 11, a groove 13 is formed to extend in a right and left direction. The block body 11 is fixed to a bending machine 14. The block body 11 includes a front shoulder 15 and a rear shoulder 16 at the front and rear sides of the groove 13. The front shoulder 15 is smaller in height than the rear shoulder 16. This means that a level difference D is defined between the front shoulder 15 and the rear shoulder 16 such that the front shoulder 15 is lower than the rear shoulder 16. The groove 13 is formed as a hollow cylinder with a semicircular cross section. Preferably, the rotating block 12 is formed as a cylinder with a semicircular cross section conforming to the groove 13.

The rotating block 12 is received by the groove 13. The rotating block 12 is formed as a cylinder with a semicircular cross section conforming to the groove 13. The rotating block 12 is capable of oscillating about an axis of the groove 13. On an upper surface 17 of the rotating block 12, a process groove 18 is formed to extend in the longitudinal direction of the rotating block 12. Although there is no stringent restriction or limitation about the sectional shape of the process groove 18, it is preferable that the front wall 19 of the process groove 18 extends downward at a substantially right angle from the upper surface 17 while the rear wall 20 is formed on a plane extending toward a front lower direction from the upper surface 17. It suffices that a bottom surface 21 of the process groove 18 is located at a depth position to sufficiently receive an end portion of an upper die (which is denoted by the reference numeral 25 and described below). In the present embodiment, a relationship among the front wall 19, the rear wall 20 and the bottom surface 21 is defined as follows. That is, the rear wall 20 extends in an inclined manner at 45 degrees from the upper surface 17 in the front lower direction and is connected to the bottom surface 21 which is parallel to the upper surface 17. As illustrated in FIG. 2, the longitudinal dimension (i.e., the width dimension) of the bottom surface 21 is equal to the height dimension of the front wall 19. An upper corner of the front wall 19 is chamfered. The process groove 18 may be located slightly forward of a central axis of the rotating block 12 (i.e., off-centered) when seen in a cross section in order for a reliable forward rotation of the rotating block when the upper die 25 and the lower die 10 are brought together.

The upper die 25 may be selected from known dies for bending. A blade edge of the die 25 is configured to be rotated in the forward direction so as to conform to the rotation operation (or an amount of rotation) of the rotating block 12. That is, an edge angle of the blade edge of the die 25 is 90 degrees but a bisector of the blade edge does not correspond to the plumb direction. The blade edge is inclined forward by an amount of rotation of the rotating block 12.

Figure 3:
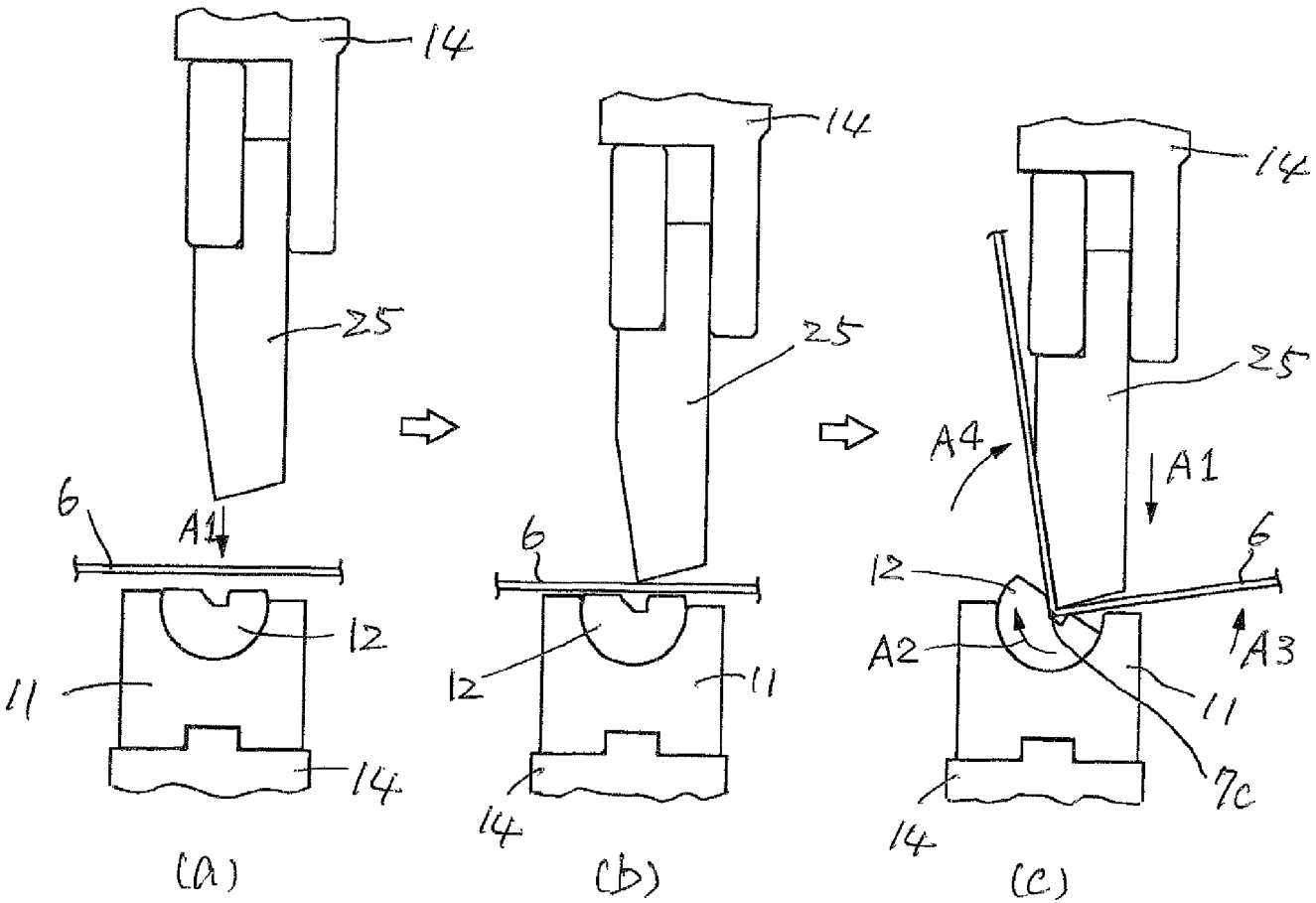
FIGS. 3A to 3C are left side views illustrating steps of a bending procedure using the tool for press bending according to the embodiment.

A bending operation with the thus-structured bending tool will be described. FIGS. 3A to 3C are left side views illustrating steps of a bending procedure using the tool for press bending according to the present embodiment. In FIGS. 3A to 3C, the reference numeral 25 denotes a die used as an upper die. The die 25 is fixed to the bending machine 14 at a position above the lower die 10. In FIG. 3A, a metal sheet 6 is placed on the lower die 10. The rotating block 12 of the lower die 10 is disposed such that the upper surface 17 is in a substantially horizontal position. From this state, the die 25 is moved in the direction of arrow A1, i.e., downward. FIG. 3B illustrates a state in which the die 25 moved downward has reached the metal sheet 6 placed on the lower die 10. A blade edge 26 of the die 25 is located at a central portion of the process groove 18 of the rotating block 12. The level difference D is defined between the front shoulder 15 and the rear shoulder 16 of the block body 11 such that the front shoulder 15 is lower than the rear shoulder 16. Thus substantially no gap exists between the metal sheet 6 and the rear shoulder 16 while a gap corresponding to the level difference D exists between the metal sheet 6 and the front shoulder 15. FIG. 3C illustrates a state in which the downwardly moved die 25 collides with the metal sheet 6 placed on the lower die 10 and is moved further downward while bending the metal sheet 6. In this manner, the blade edge 26 enters the process groove 18. At the rear side of the block body 11, the metal sheet 16 is completely supported by the rear shoulder 16. At the front side of the block body 11, however, the gap exists between the metal sheet 6 and the front shoulder 15 and the metal sheet 6 is not supported. Thus, as the blade edge 26 enters the process groove 18, the rotating block 12 rotates in the direction of arrow A2 and the upper surface 17 is inclined forward. As the blade edge 26 enters the process groove 18, the metal sheet 6 receives the bending action at a bending point 7*c*. A front side and a rear side of the metal sheet 6 are rotated in the directions of arrows A3 and A4, respectively, about the bending point 7*c*. Thus the metal sheet 6 is bent to substantially the right angle to provide an L-shaped work.

Figure 4:
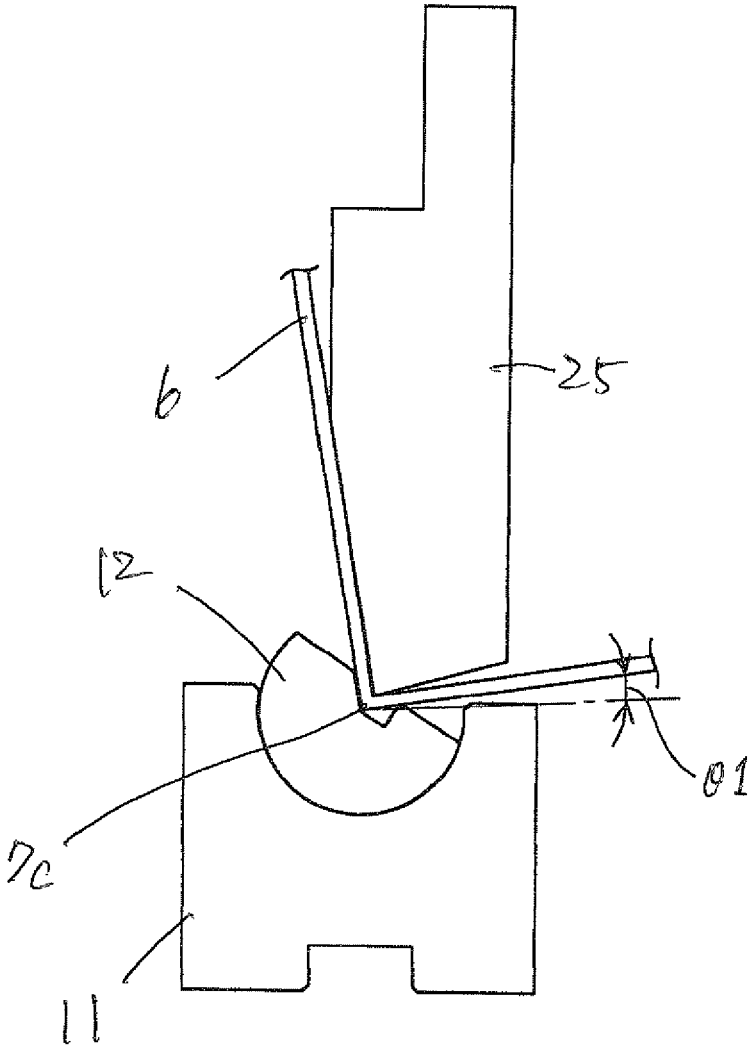
FIG. 4 is an expanded left side view of state in which the bending operation using the tool for press bending according to the embodiment is completed.

FIG. 4 is an expanded left side view of a state in which the bending illustrated in FIG. 3C is completed. As is apparent from FIG. 4, in a state in which the front and rear sides of the metal sheet 6 are rotated in the directions of arrows A3 and A4, respectively, about the bending point 7*c* and the metal sheet 6 is bent to substantially the right angle, the front side is held between a corner portion, formed between the upper surface 17 and the front wall 19, and the die 25 and the rear side is held between the rear wall 20 and the die 25. Since the rotating block 12 is inclined forward, the front side of the metal sheet 6 is moved upward by as small angle as θ1 with respect to the horizontal plane. The amount (i.e., dimension) of the upward movement is controlled to the minimum.

Figure 5:
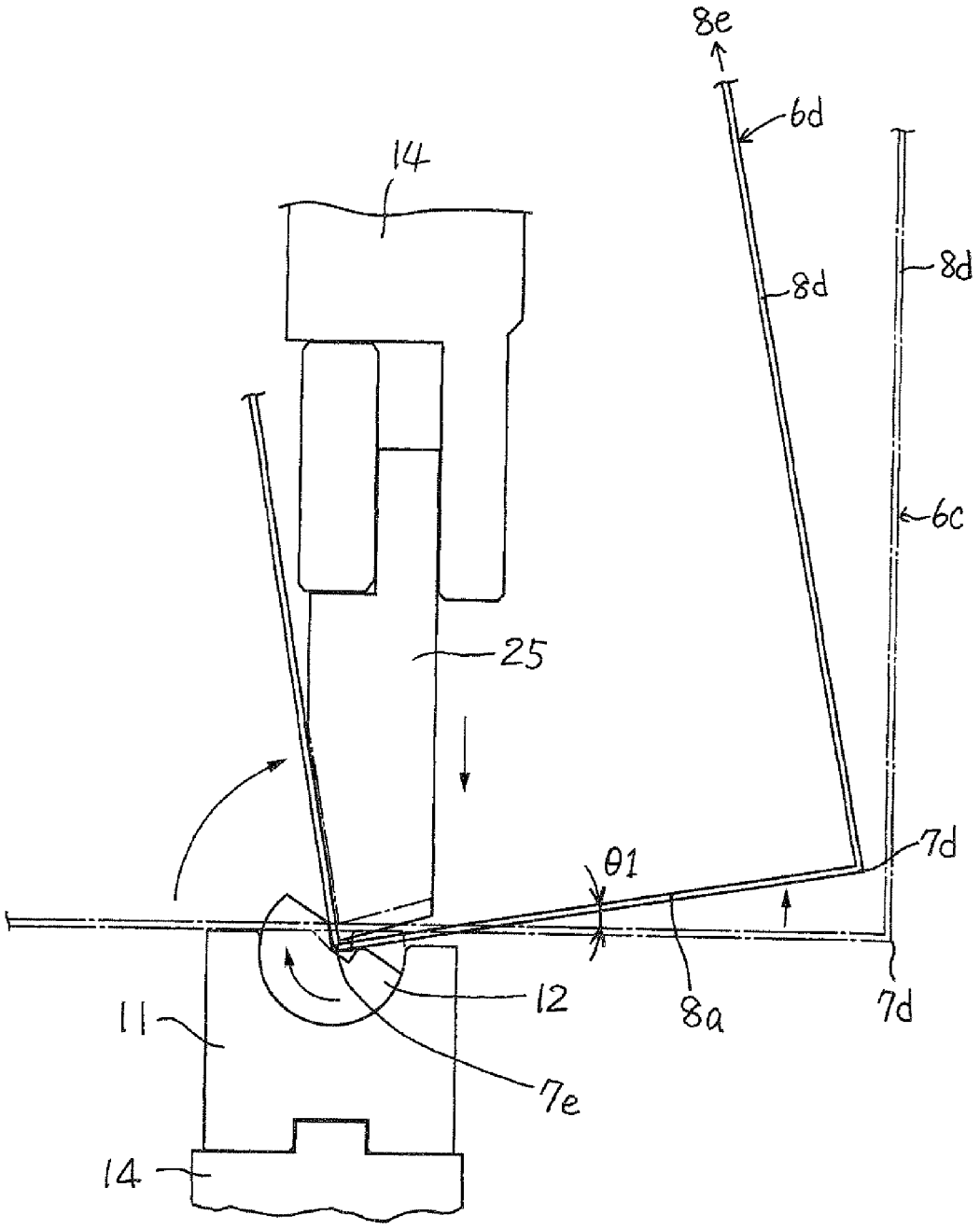
FIG. 5 is a left side view of a state in which a bending operation of a U-shaped metal piece using the tool for press bending according to the embodiment is completed.
Figure 6:
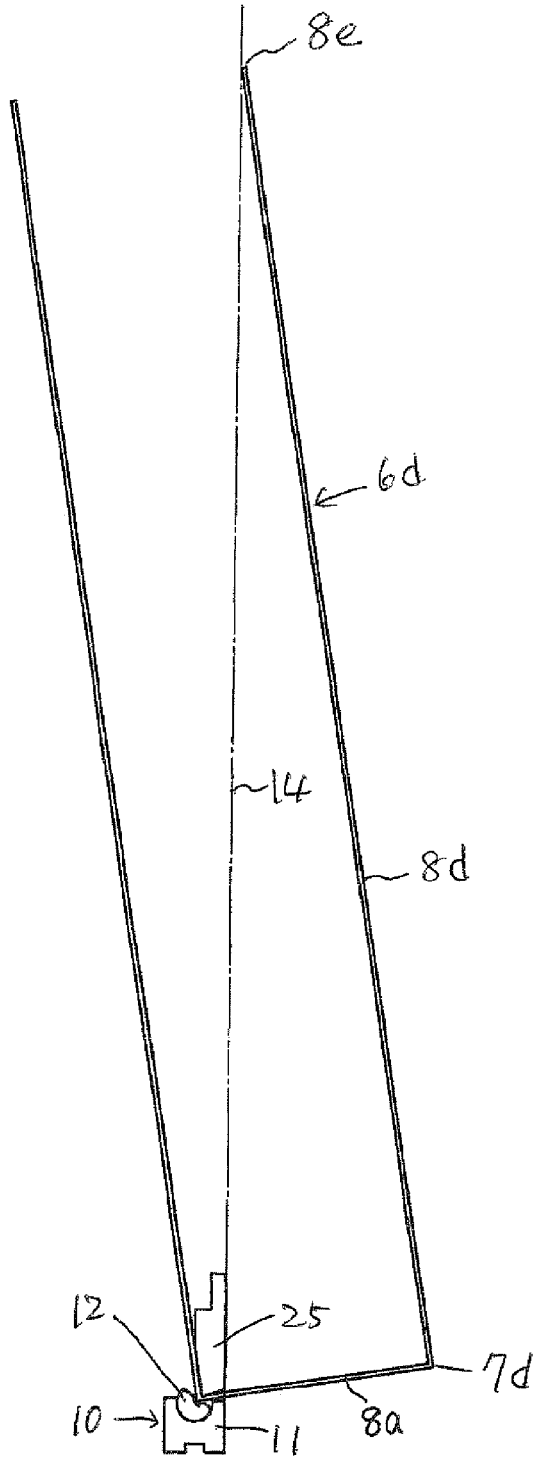
FIG. 6 is a left side view illustrating theoretical possibility of the bending operation of the U-shaped metal piece using the tool for press bending according to the embodiment.
Figure 9:
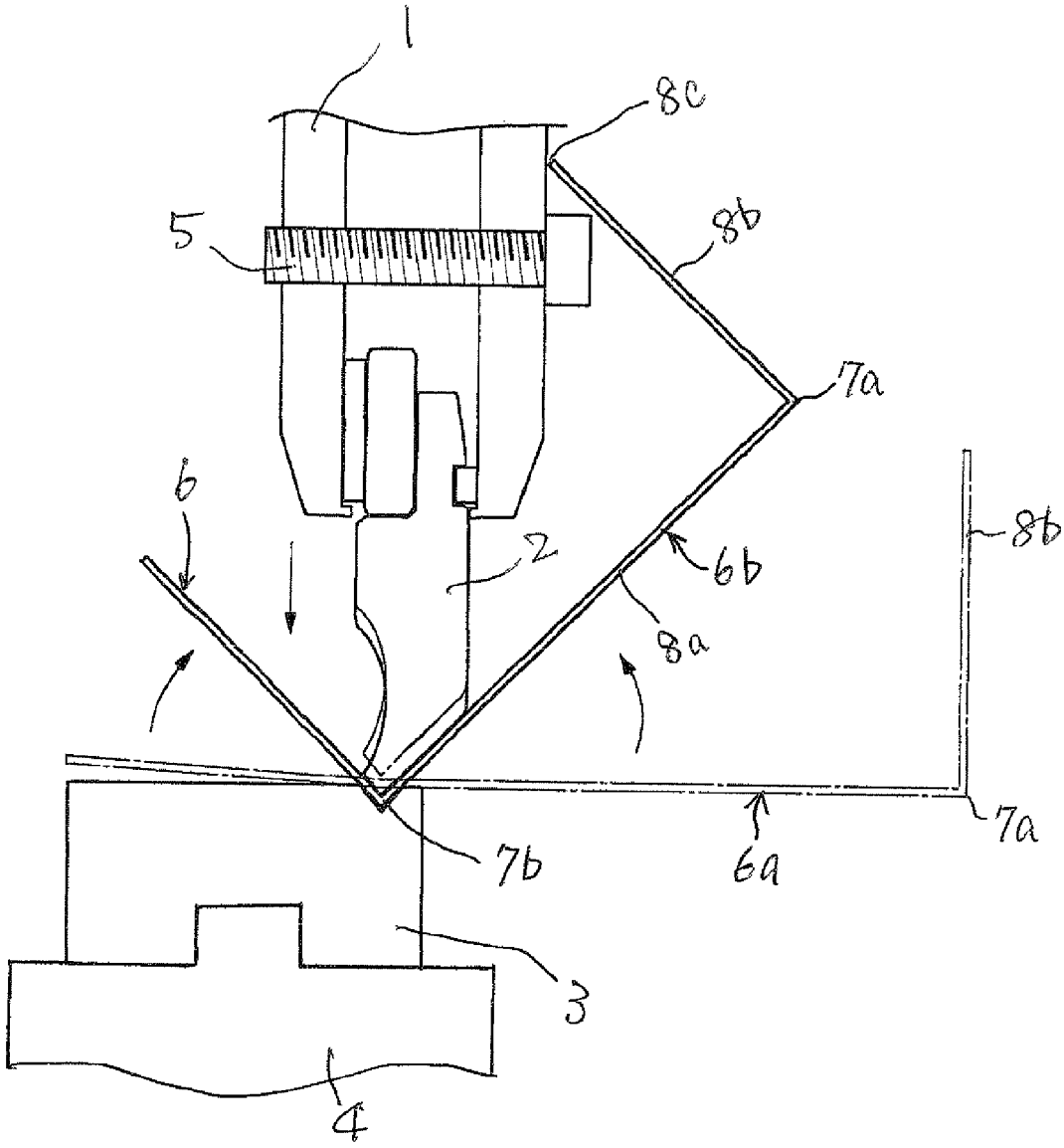
Fig. 9 (Prior Art)
FIG. 9 is a left side view of a state in which a bending operation of a U-shaped metal piece using the related art tool for press bending is completed.

Next, the manufacture of a U-shaped metal piece using the bending tool according to the invention will be described with reference to FIGS. 5 and 6. The metal sheet 6 is bent in a manner similar to that described with reference to FIG. 9. That is, the metal sheet 6 is placed on the lower die 10 and is bent in a first bending operation into L shape at a certain bending position (i.e., location) set for the bending of the metal sheet 6 into U shape. Since the invention aims at manufacturing a U-shaped metal piece of increased depth as compared with the related art examples, a distance between an end of the metal sheet 6 and the processing location is set to be larger than that of the example of FIG. 9. In this manner, an L-shaped work 6*c* (indicated by dashed dotted lines in FIG. 5) bent into the right angle at a first bending point 7*d* is obtained. The obtained L-shaped work is moved along a front-rear direction on the lower die 10 to set a bending position (i.e., location) for bending into U shape. The metal sheet 6 is bent into L shape at the bending position in a second bending operation. In this manner, a U-shaped metal piece 6*d* (indicated by solid lines in FIG. 5) is obtained which is bent into the right angle at a second bending point 7*e* and is also bent at the first bending point 7*e*. As described above, the U-shaped metal piece 6*d* is manufactured through bending operations into L shape at two different positions on the metal sheet 6. A side between the two positions 7*a* and 7*b* at which the metal sheet 6 is bent into L shape is defined as a base 8*a* of the U-shaped metal piece 6*d*. In order to clarify the difference between the U-shaped metal piece 6*d* of the invention illustrated in FIG. 5 and the U-shaped metal piece 6*b* of the related art illustrated in FIG. 9, both the U-shaped metal pieces 6*b* and 6*d* have the base 8*a* of the same configuration, i.e., of the same length.

The metal sheet 6 is bent into L shape twice using the bending tool according to the invention during the manufacture of the U-shaped metal piece 6*d*. Since the rotating block 12 is inclined forward, an amount (i.e., dimension) of upward movement of the base 8*a* of the U-shaped metal piece 6*d* from the second bending point 7*b* formed in the second bending operation is controlled to the minimum when the metal sheet 6 is bent in the second bending operation into L shape. The base 8*a* extends in the direction of as small angle as θ1 with respect to the horizontal plane, which is much smaller than 45 degrees. A vertical side 8*d* (which corresponds to one of legs of the U-shaped metal piece 6*d*) extends at 90 degrees from an end of the base 8*a* (i.e., from the first bending point 7*d*). Thus the vertical side 8*b* extends from the end of the base 8*a* at (θ1+90) degrees (i.e., at a reversed angle of θ1). Since the vertical side 8*d* is moved in the reverse direction by as small angle as θ1, the end (8*e*) of the vertical side 8*d* does not easily interfere with the surface of the bending machine 14 even if the length dimension of the vertical side 8*d* is significantly increased. This means that the bending tool of the invention can provide a U-shaped metal piece 6*d* of significantly greater depth as compared with the length of the base 8*a*. FIG. 6 illustrates a theoretical collision point of the invention. A dashed dotted line indicates a position of a surface of the bending machine 14. As is apparent from FIG. 6, the reversed angle θ1 of the vertical side 8*d* of the U-shaped metal piece 6*d* is much smaller than 45 degrees. The vertical side 8*d* extends in a direction much closer to the plumb line and interferes with the body of the bending machine 14 at the end 8*e* finally. In the example of the U-shaped metal piece 6*d* illustrated in FIG. 6, the ratio of the base to the vertical side is 1:5.5. As compared with the ratio of the base to the vertical side of the related art, it is known that the maximum length of the vertical side is increased significantly.

As described above, in the manufacture of the U-shaped metal piece 6*d*, the base 8*a* is inclined forward so as to conform to the rotating block 12 which is inclined forward of the bending machine 14. Thus the front portion of the base of the U-shaped metal piece is moved upward by as small angle as θ1 with respect to the horizontal plane at the front side of the bending machine 14. The reversed angle θ1 of the vertical side 8*d* of the U-shaped metal piece 6*d* is much smaller than 45 degrees. The vertical side 8*d* extends in the direction much closer to the plumb line. It rarely happens that the end of the vertical side 8*d* interferes with the body of the bending machine 14 even if the vertical side 8*d* is long. Accordingly, a U-shaped metal piece 6*d* of greater depth can be manufactured through press bending.

Figure 7:
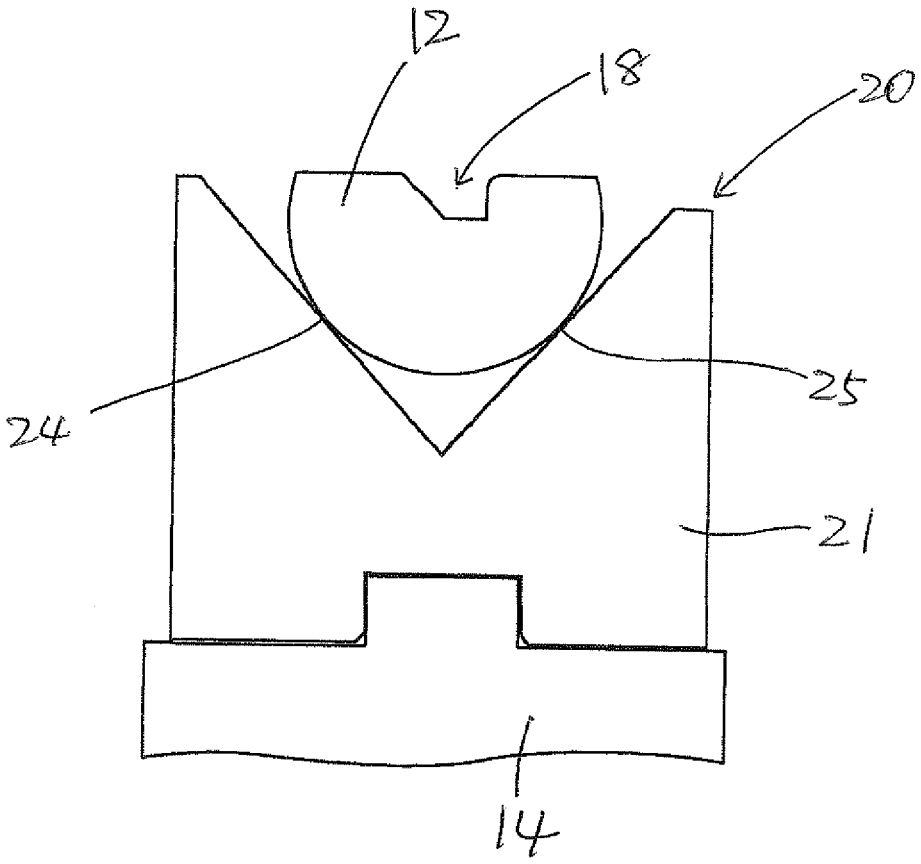
FIG. 7 is a left side view of another embodiment of a lower die of a tool for press bending according to the invention.

FIG. 7 is a left side view of another embodiment of a lower die of a tool for press bending according to the invention. In this embodiment, a V-shaped groove 23 is formed in a block body 21 of a lower die 20. A rotating block 12 similar to that of the first embodiment is received by the groove 23. Other components are the same as those of the first embodiment. In this configuration, the rotating block 12 is supported at contact points 24 and 25 with the groove 23. Thus the rotating block 12 can be oscillated while being supported at the contact points 24 and 25.

Figure 8:
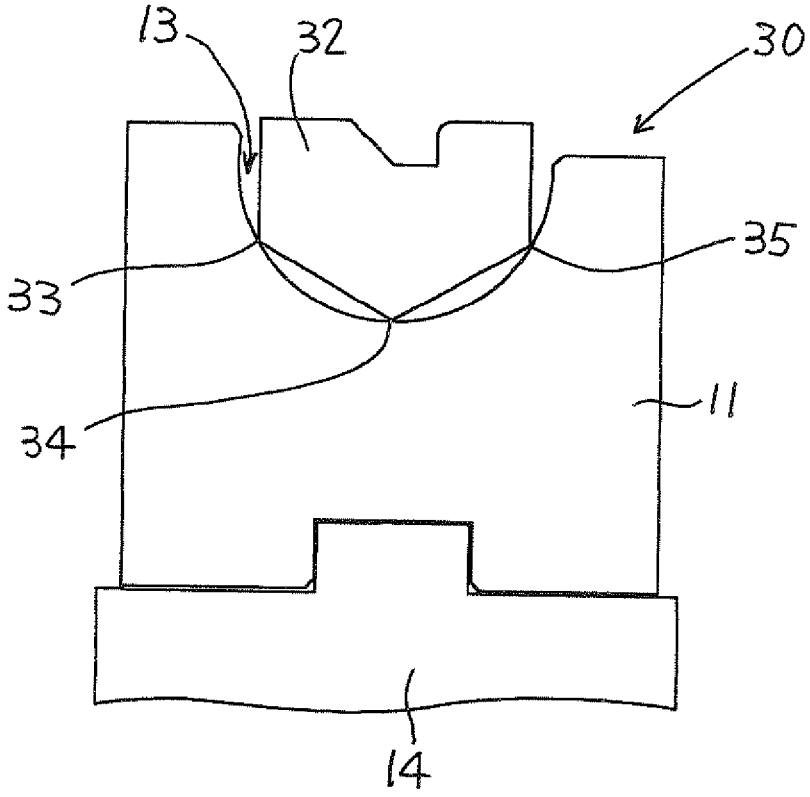
FIG. 8 is a left side view of still another embodiment of a lower die of a tool for press bending according to the invention.

FIG. 8 is a left side view of still another embodiment of a lower die of a tool for press bending according to the invention. In this embodiment, a block body 11 similar to that of the first embodiment is used as a block body of the lower die 30. A rotating block 32 has a polygonal cross section and is received by a groove 13 of the block body 11 with polygonal corners (i.e., contact points) 33, 34 and 35 being in contact with a surface of the groove 13. Other components are the same as those of the first embodiment. In this configuration, the rotating block 32 is supported at contact points 33, 34 and 35 with the groove 13. Thus the rotating block 32 can be oscillated while being supported at the contact points 33, 34 and 35.

When the upper die and the lower die are brought together with the metal sheet placed on the lower die, the blade edge of the upper die enters the process groove of the rotating block while bending the metal sheet and the rotating block is rotated forward. At the bending point, the L-shaped work is inclined forward together with the rotating block which is inclined forward of the bending machine. Thus the amount of upward movement of the metal sheet during the bending operation can be controlled to the minimum. With this configuration, the operator can stay safe. In addition, a U-shaped metal piece of increased depth can be manufactured, which provides greater utility.

What is claimed is:

1. A lower die for press bending comprising:

a) a block body which includes a groove on an upper surface thereof, the groove extending in a right and left direction, and the block body being fixed to a bending machine; and b) a rotating block which is received by the groove of the block body and is capable of oscillating about an axis of the groove, c) wherein the rotating block has an upper surface on which a metal sheet to be bent is placed, a process groove is formed on an upper surface of the rotating block to receive a blade edge of an upper die, and the process groove is off-centered and located slightly forward of a central axis of the rotating block when seen in a cross section, and d) the block body has a front shoulder and a rear shoulder at front and rear sides of the groove with front and rear directions of the bending machine as reference directions and a level difference is defined between these front and rear shoulders such that the front shoulder is smaller in height than the rear shoulder, e) whereby, when the process groove receives the blade edge of the upper die, the rotating block rotates in the forward direction in a manner that the metal sheet to be bent is placed on the upper surface of the rotating block, and the level difference defined between the front and rear shoulders of the block body receives a front side part of the die contact of the metal sheet being inclined forward.

2. The lower die for press bending according to claim 1, wherein the groove is formed as a hollow cylinder with a semicircular cross section and the rotating block is formed as a cylinder with a semicircular cross section conforming to the groove.

3. The lower die for press bending according to claim 2 wherein the process groove is formed on the upper surface of the rotating block to extend in a longitudinal direction of the rotating block and a front wall of the process groove extends downward at a substantially right angle from the upper surface while a rear wall is formed on a plane extending toward a front lower direction from the upper surface.

4. A tool for press bending which includes an upper die consisting of a die disposed with a blade edge thereof facing downward and a lower die including a mold recess disposed opposite to the upper die, the upper and lower dies are disposed along a vertical direction, wherein:

the lower die comprises a block body which includes a groove extending in a right and left direction on an upper surface thereof, the block body being fixed to a bending machine, and a rotating block which is received by the groove of the block body and is capable of oscillating about an axis of the groove;

the rotating block has an upper surface (17) on which a metal sheet (6) to be bent is placed, a process groove (18) is formed on an upper surface (17) of the rotating block to receive a blade edge of an upper die, and the process groove (18) is off-centered and locates slightly forward of a central axis of the rotating block when seen in a cross section, the block body has a front shoulder and a rear shoulder at front end and rear sides of the groove with front and rear directions of the bending machine as reference directions and a level difference is defined between these front and rear shoulders such that the front shoulder is smaller in height than the rear shoulder, whereby, when the process groove (18) receives the blade edge of the upper die, the rotating block rotates in the forward direction in a condition that the metal sheet (6) to be bent is placed on the upper surface (17) of the rotating block, and the level difference defined between the front and rear shoulders of the block body receives a front side part of the die contact of the metal sheet being inclined forward, and the upper die is configured such that an edge angle of the blade edge thereof is formed 90 degrees but a line through the blade edge at 45° does not correspond to a plumb direction, but is inclined forward by an amount of rotation of the rotating block; and the blade edge of the upper die is located at a central portion of the process groove of the rotating block and holding the condition of being inclined forward.

5. A lower die for press bending, comprising:

a lower block body having an upper surface with a groove therein, the groove in the upper surface of the lower block body extending in a right and left direction, and the block body being fixed to a bending machine;

a rotatable block received within the groove of the block body, the rotateable block being capable of and adapted to rotate within the groove about an axis of the groove;

the rotatable block having an upper surface in which a process groove extends in a right and left direction, the process groove having a rear wall (20), a front wall (19), and a bottom wall (21) between and connecting the rear wall and the front wall, wherein the rear wall (20) and the bottom wall (21) are inclined from one another at an angle greater than 90°, and the front wall and the rear wall both extend upwardly and define a cavity.

* * * * *